US008854295B2

(12) United States Patent
Sano et al.

(10) Patent No.: US 8,854,295 B2
(45) Date of Patent: Oct. 7, 2014

(54) LIQUID CRYSTAL DISPLAY FOR DISPLAYING AN IMAGE USING A PLURALITY OF LIGHT SOURCES

(75) Inventors: Yuma Sano, Tokyo (JP); Ryosuke Nonaka, Yokohama (JP); Masahiro Baba, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 546 days.

(21) Appl. No.: 12/953,843

(22) Filed: Nov. 24, 2010

(65) Prior Publication Data

US 2011/0169873 A1 Jul. 14, 2011

(30) Foreign Application Priority Data

Jan. 13, 2010 (JP) ..... 2010-5219

(51) Int. Cl.
*G09G 3/36* (2006.01)
*G09G 3/34* (2006.01)

(52) U.S. Cl.
CPC ..... *G09G 3/3611* (2013.01); *G09G 3/3426* (2013.01); *G09G 2320/0626* (2013.01); *G09G 2320/0233* (2013.01); *G09G 2360/16* (2013.01)
USPC ..... 345/102; 345/690; 345/694; 348/687

(58) Field of Classification Search
CPC ..... G02B 26/02
USPC ..... 345/87–103, 690, 694; 348/687
See application file for complete search history.

(56) References Cited

U.S. PATENT DOCUMENTS

2006/0214904 A1* 9/2006 Kimura et al. ..... 345/102
2006/0279564 A1* 12/2006 Nuimura ..... 345/207
2008/0111784 A1* 5/2008 Tanaka et al. ..... 345/102
2009/0140975 A1* 6/2009 Nonaka et al. ..... 345/102
2009/0290091 A1* 11/2009 Tsuchida et al. ..... 349/61
2010/0238201 A1 9/2010 Nonaka et al.

FOREIGN PATENT DOCUMENTS

JP 2008-122713 5/2008

OTHER PUBLICATIONS

U.S. Appl. No. 13/072,094, filed Mar. 25, 2011, Nonaka, et al.

* cited by examiner

*Primary Examiner* — Alexander S Beck
*Assistant Examiner* — Charles Zheng
(74) *Attorney, Agent, or Firm* — Oblon, Spivak, McClelland, Maier & Neustadt, L.L.P.

(57) ABSTRACT

There is provided a liquid crystal display, including: a backlight having a plurality of light sources; a liquid crystal panel configured to display a video picture in a plurality of illumination regions corresponding to the light sources; an intensity value calculator calculating representative intensity values of the illumination regions based on an input video signal; a weight calculator performing a smoothing process on the representative intensity values by using first weights and to calculate second weights of the illumination regions having values which become larger as smoothed values of the representative intensity values becomes smaller than the representative intensity values; an intensity value corrector correcting the representative intensity values of the illumination regions based on the second weights and performe a smoothing process on corrected intensity values by using the first weights to obtain light source intensity values of the light sources.

12 Claims, 12 Drawing Sheets

| | | | | | |
|---|---|---|---|---|---|
| 50 | 50 | 50 | 50 | 50 | 50 |
| 50 | 50 | 50 | 50 | 50 | 50 |
| 50 | 50 | 255 | 255 | 50 | 50 |
| 50 | 50 | 255 | 255 | 50 | 50 |
| 50 | 50 | 50 | 50 | 50 | 50 |
| 50 | 50 | 50 | 50 | 50 | 50 |

(a) ORIGINAL INTENSITY SET VALUES

| | | | | | |
|---|---|---|---|---|---|
| 52 | 56 | 61 | 61 | 56 | 52 |
| 55 | 70 | 92 | 92 | 70 | 55 |
| 59 | 90 | 132 | 132 | 90 | 59 |
| 59 | 90 | 132 | 132 | 90 | 59 |
| 55 | 70 | 92 | 92 | 70 | 55 |
| 52 | 56 | 61 | 61 | 56 | 52 |

(b) SMOOTHED BY GAUSSIAN FILTER

| | | | | | |
|---|---|---|---|---|---|
| 50 | 50 | 51 | 51 | 50 | 50 |
| 50 | 51 | 153 | 153 | 51 | 50 |
| 51 | 153 | 255 | 255 | 153 | 51 |
| 51 | 153 | 255 | 255 | 153 | 51 |
| 50 | 51 | 153 | 153 | 51 | 50 |
| 50 | 50 | 51 | 51 | 50 | 50 |

(c) SMOOTHED BY CONVENTIONAL METHOD (DIFFERENCE THRESHOLD VALUE A)

| | | | | | |
|---|---|---|---|---|---|
| 50 | 50 | 51 | 51 | 50 | 50 |
| 50 | 51 | 114 | 114 | 51 | 50 |
| 51 | 114 | 255 | 255 | 114 | 51 |
| 51 | 114 | 255 | 255 | 114 | 51 |
| 50 | 51 | 114 | 114 | 51 | 50 |
| 50 | 50 | 51 | 51 | 50 | 50 |

(d) SMOOTHED BY CONVENTIONAL METHOD (RATIO THRESHOLD VALUE B)

| | | | | | |
|---|---|---|---|---|---|
| 50 | 51 | 74 | 74 | 51 | 50 |
| 51 | 74 | 165 | 165 | 74 | 51 |
| 74 | 165 | 255 | 255 | 165 | 74 |
| 74 | 165 | 255 | 255 | 165 | 74 |
| 51 | 74 | 165 | 165 | 74 | 51 |
| 50 | 51 | 74 | 74 | 51 | 50 |

(e) SMOOTHED BY CONVENTIONAL METHOD (DIFFERENCE THRESHOLD VALUE C)

| | | | | | |
|---|---|---|---|---|---|
| 50 | 51 | 75 | 75 | 51 | 50 |
| 51 | 75 | 138 | 138 | 75 | 51 |
| 75 | 138 | 255 | 255 | 138 | 75 |
| 75 | 138 | 255 | 255 | 138 | 75 |
| 51 | 75 | 138 | 138 | 75 | 51 |
| 50 | 51 | 75 | 75 | 51 | 50 |

(f) SMOOTHED BY CONVENTIONAL METHOD (RATIO THRESHOLD VALUE D)

| | | | | | |
|---|---|---|---|---|---|
| 54 | 62 | 74 | 74 | 62 | 54 |
| 62 | 96 | 139 | 139 | 96 | 62 |
| 74 | 139 | 225 | 225 | 139 | 74 |
| 74 | 139 | 225 | 225 | 139 | 74 |
| 62 | 96 | 139 | 139 | 96 | 62 |
| 54 | 62 | 74 | 74 | 62 | 54 |

(g) SMOOTHED BY PROPOSED METHOD

| | | | | |
|---|---|---|---|---|
| 0.023 | 0.095 | 0.15 | 0.095 | 0.023 |
| 0.095 | 0.39 | 0.62 | 0.39 | 0.095 |
| 0.15 | 0.62 | 1 | 0.62 | 0.15 |
| 0.095 | 0.39 | 0.62 | 0.39 | 0.095 |
| 0.023 | 0.095 | 0.15 | 0.095 | 0.023 |

(h) 5x5 GAUSSIAN FILTER

FIG. 6

(a) COMPARISON ON INTENSITY OF EACH REGION AMONG PROPOSED METHOD, CONVENTIONAL METHOD (DIFFERENCE THRESHOLD VALUE A), AND CONVENTIONAL METHOD (RATIO THRESHOLD VALUE B)

(b) COMPARISON ON INTENSITY OF EACH REGION AMONG PROPOSED METHOD, CONVENTIONAL METHOD (DIFFERENCE THRESHOLD VALUE C), AND CONVENTIONAL METHOD (RATIO THRESHOLD VALUE D)

LIQUID CRYSTAL DISPLAY FOR DISPLAYING AN IMAGE USING A PLURALITY OF LIGHT SOURCES

CROSS REFERENCE TO RELATED APPLICATIONS

This application is based upon and claims the benefit of priority from the prior Japanese Patent Application No. 2010-5219, filed on Jan. 13, 2010, the entire contents of which are incorporated herein by reference.

FIELD

Embodiments described herein relates to a liquid crystal display including a backlight having a plurality of light sources.

BACKGROUND

Studies on a liquid crystal display have been developed as to the technique for controlling the intensity of light emitted from a backlight in accordance with a video signal in order to improve the contrast of a video picture to be displayed and to reduce power consumption. According to a general method, a screen is divided into a plurality of regions, and the intensity of a light source arranged in each region is separately controlled in accordance with a video signal.

However, the division number of the regions for which the intensity of the light sources is controlled is considerably smaller than the number of pixels of an input video picture, which causes a problem that a video picture having mixed bright and dark areas as in a night view suffers image deterioration such as uneven brightness and brightness variation due to the separate control by the light sources.

In a method suggested to avoid the image deterioration such as uneven brightness and brightness variation caused in the input video picture, a maximum luminance in divided regions for which the light sources are controlled (hereinafter referred to as illumination region) is calculated as light source intensity of the illumination region, and the light source intensity value is corrected to be increased so that the difference in the light source intensity between each illumination region and its adjacent illumination region becomes a permissible value or smaller.

However, in this method, the intensity of each illumination region is corrected to be increased in accordance with the maximum light source intensity value in all illumination regions and thus the intensity of the illumination regions becomes totally high to reduce uneven brightness, which leads to a problem that light emitted from the light sources becomes wastefully bright. Further, the threshold value for the intensity difference between the illumination regions adjacent to each other should be made larger in order to reduce power consumption, which leads to a problem that uneven brightness and brightness variation cannot be sufficiently reduced.

BRIEF DESCRIPTION OF THE DRAWINGS

FIG. 6 is a diagram explaining an effect of the first embodiment.

DETAILED DESCRIPTION

According to one embodiment, there is provided with a liquid crystal display including a backlight, a liquid crystal panel, an intensity value calculator, a weight calculator, an intensity value corrector, an intensity distribution estimator, a signal corrector, a light source controller and a liquid crystal controller.

The backlight has a plurality of light sources each configured to emit light, light intensity of each light source being controllable.

The liquid crystal panel displays a video picture in a plurality of illumination regions corresponding to the light sources by modulating the light from the backlight.

The intensity value calculator calculates representative intensity values of the illumination regions based on an input video signal including signal values of a plurality of pixels.

The weight calculator performs a smoothing process on the representative intensity values by using first weights which are previously defined for the illumination regions, and calculates second weights of the illumination regions having values which become larger as smoothed values of the representative intensity values become smaller than the representative intensity values.

The intensity value corrector corrects the representative intensity values of the illumination regions based on the second weights and performs a smoothing process on corrected intensity values to obtain light source intensity values of the light sources.

The intensity distribution estimator estimates light intensity distribution in the illumination regions when the light sources emit the light with the light source intensity values.

The signal corrector corrects the input video signal based on the intensity distribution to obtain a corrected video signal.

The light source controller controls the light sources so that the light sources emit light with intensity having the light source intensity values.

The liquid crystal controller controls modulation of the liquid crystal panel in accordance with the corrected video signal.

In the following, embodiments will now be in detail explained with reference to the accompanying drawings. Note that structures or processes based on a similar operation are given the same symbols, and the explanation thereof will be omitted.

First Embodiment

Figure 1:
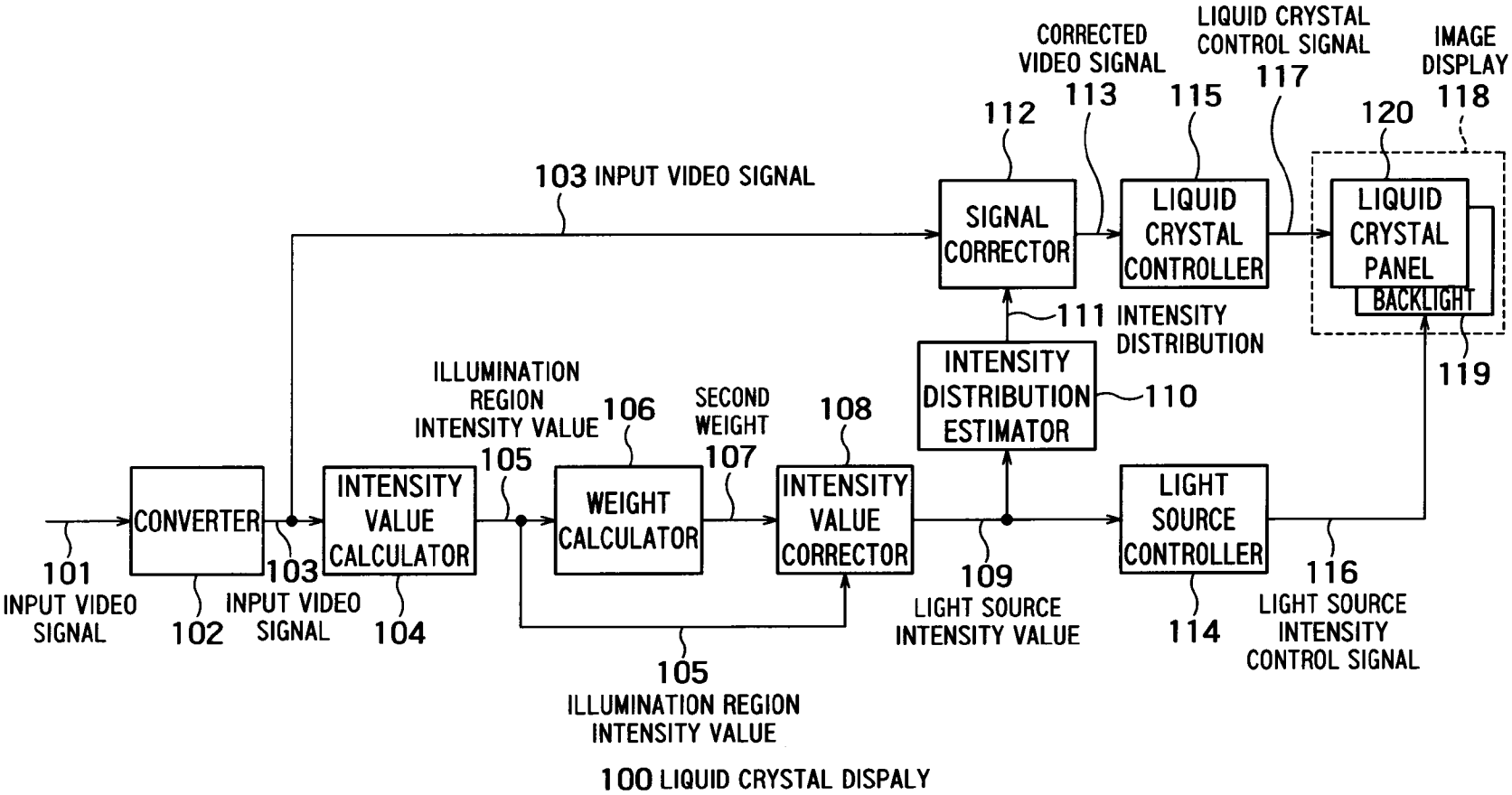
FIG. 1 is a diagram showing a liquid crystal display according to a first embodiment.

FIG. 1 is a diagram showing a liquid crystal display 100 in the present embodiment.

The liquid crystal display 100 includes: a converter 102; an intensity value calculator 104; a weight calculator 106; an intensity value corrector 108; an intensity distribution estimator 110; a signal corrector 112; an image display 118; a light source controller 114; and a liquid crystal controller 115.

The image display 118 includes: a backlight 119 having a plurality of light sources each of which has separately controllable light intensity; and a liquid crystal panel 120 for modulating the transmissivity or reflectivity of light from the backlight 119. The light source controller 114 controls the intensity of each light source in the backlight 119. The liquid crystal controller 115 drives and controls the liquid crystal panel 120. The present embodiment will be explained based on an example in which each light source in the backlight 119 is a white light emitting diode (LED).

The converter 102 performs format conversion into an RGB format and gamma conversion on an input video signal 101 to obtain an input video signal 103. Note that the format conversion is omitted when the input video signal 101 already has the RGB format.

Here, regions obtained by virtually dividing a display region of the liquid crystal panel 120 based on a spatial arrangement of the light sources in the backlight 119 are defined as illumination regions. That is, the number of the illumination regions is the same as the number of light sources, and each illumination region is related to a different light source (in the closest position). The correspondence between the signal value of each pixel in the input video signal 103 and each illumination region is previously defined and stored in the intensity value calculator 104.

The intensity value calculator 104 calculate, based on the input video signal 103, an illumination region intensity value (representative intensity value) 105 with respect to each illumination region, the illumination region intensity value 105 being a representative value among the intensity values of the pixels in each illumination region.

The weight calculator 106 smoothes the representative intensity value of each illumination region by using a first weight defined depending on a positional relationship (relative position) among the illumination regions, and calculates the second weight 107 with respect to each illumination region, the second weight 107 having a value which becomes larger as the smoothed intensity value of each illumination region becomes smaller than the representative intensity value of each illumination region. Note that the first weight is a value which is constant regardless of the input image and is previously stored in an LUT.

The intensity value corrector 108 corrects the illumination region intensity value 105 based on the first weight and the second weight 107, and calculates a light source intensity value 109 of each illumination region. In more detail, the intensity value corrector 108 obtains a corrected intensity value by correcting each representative intensity value based on the second weight 107 of each illumination region, respectively and smooths each corrected intensity value by using the first weight to obtain a smoothed intensity value of each illumination region as the light source intensity value 109 of each illumination region (in a similar way of the weight calculator 106).

The intensity distribution estimator 110 estimates intensity (hereinafter referred to as intensity distribution) 111 of light incident on each pixel position of the liquid crystal panel 120 when the backlight 119 irradiates light on the liquid crystal panel 120 in accordance with the light source intensity value 109.

The signal corrector 112 obtains a corrected video signal 113 by correcting the input video signal 103 in accordance with the intensity distribution 111 in order to correct the transmissivity or reflectivity of the liquid crystal panel.

The light source controller 114 generates a light source intensity control signal 116 for controlling each light source so that each light source emits light with the intensity depending on the light source intensity value 109, and transmits the light source intensity control signal 116 to the backlight 119.

The backlight 119 makes each light source emit light in accordance with the light source intensity control signal 116 from the light source controller 114.

The liquid crystal controller 115 generates, in accordance with the corrected video signal 113, a liquid crystal control signal 117 for controlling the transmissivity or reflectivity of the liquid crystal panel with respect to each pixel, and transmits the liquid crystal control signal 117 to the liquid crystal panel 120.

The liquid crystal panel 120 sets the transmissivity or reflectivity of the liquid crystal panel with respect to each pixel in accordance with the liquid crystal control signal 117 from the liquid crystal controller 115, and displays a video picture depending on the corrected video signal 113 in the display region (each illumination region) by modulating light emitted from the backlight 119.

Figure 2:
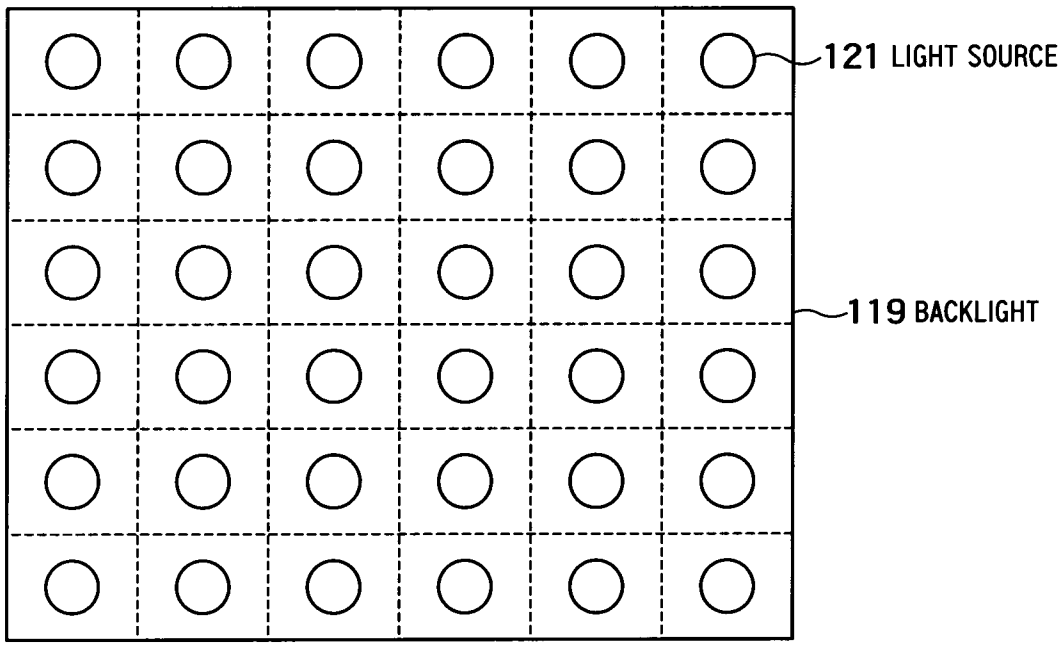
FIG. 2 is a diagram showing a detailed structure of a backlight.

FIG. 2 is a diagram showing a detailed structure of the backlight 119.

The backlight 119 includes a plurality of white light sources 121. Each light source has luminescence has separately controllable light intensity. Note that the backlight structure shown in FIG. 2 is one example, and thus another structure may be employed.

Next, the operation of the liquid crystal display 100 in the present embodiment will be explained in detail.

Figure 3:
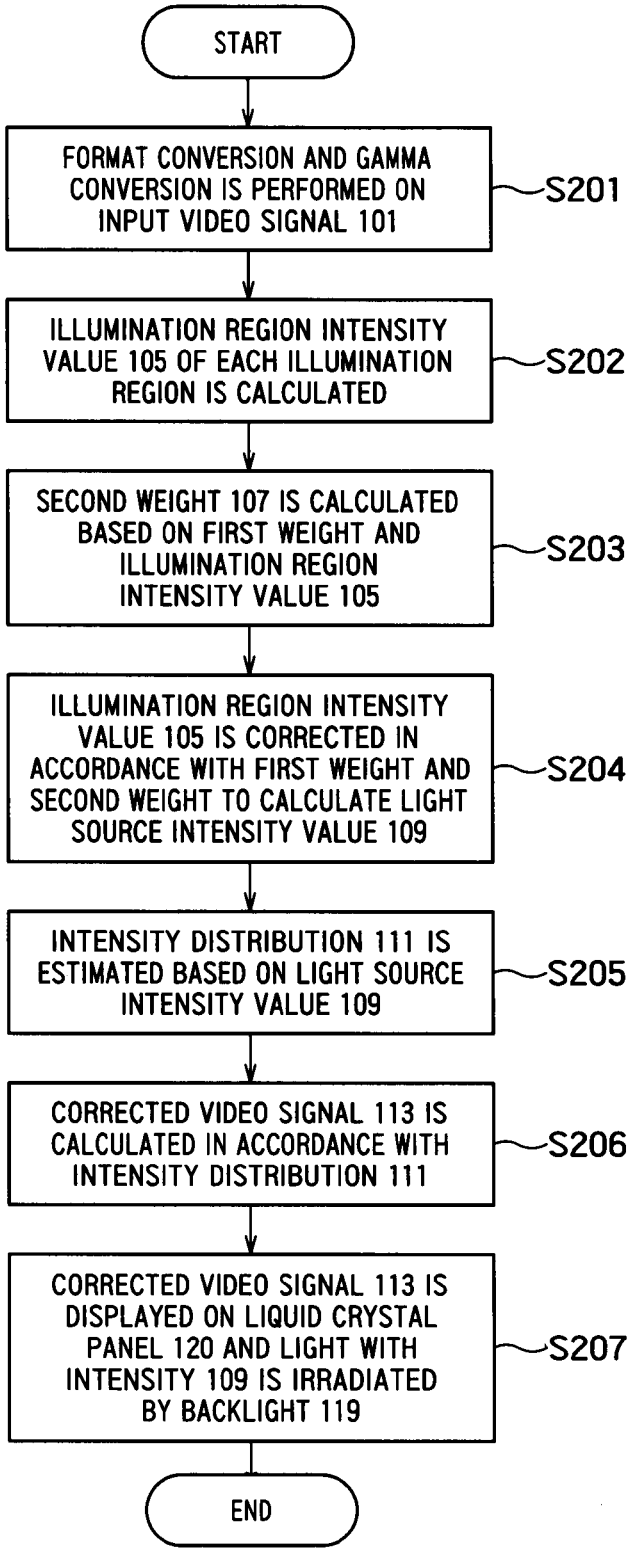
FIG. 3 is a flow chart showing a flow of the operation of the liquid crystal display.

FIG. 3 is a flow chart showing a flow of the operation of the liquid crystal display 100 in the present embodiment.

First, the converter 102 converts the signal of each pixel of the input video signal 101 into a signal based on an RGB format. After that, a gray-scale level value (or gradation level value) $S_{in}$ of each color component of each pixel is converted into $L_{in}$ by performing gamma conversion based on Formula (1).

$$L_{in} = \left(\frac{S_{in}}{255}\right)^{\gamma} \tag{1}$$

$\gamma$ represents a gamma coefficient. Calculation for the gamma conversion may be performed by referring to a lookup table in which the correspondence between an input gray-scale level value and a gamma-converted gray-scale level value is previously determined. The above conversion is performed on each of R, G, and B values of every pixel of the input video signal 101 to obtain the input video signal 103 which is thus gamma-converted (S201).

Next, the intensity value calculator 104 calculates a maximum value among the R, G, and B signal values with respect to each pixel of the input video signal 103, the maximum value being calculated as the intensity value of each pixel. In the present embodiment, the maximum value among the R, G, and B signal values is set as the intensity value of each pixel, but the intensity value of each pixel may be a mean value of the R, G, and B signal values or a Y signal value among Y, U, and V signal values obtained by converting the R, G, and B signal values. Further, the intensity value calculator 104 calculates a maximum value among the intensity values of the pixels in each illumination region as an illumination region intensity value (representative intensity value) 105 (S202). In the present embodiment, the illumination region intensity value 105 is a maximum value among the intensity values of the pixels in each illumination region, but the illumination region intensity value 105 may be a value obtained by multiplying a central lightness value between a maximum lightness value and a minimum lightness value of the pixels in each illumination region by a constant, or a mean, mode, or median value of the intensity values of the pixels in each illumination region.

Next, the weight calculator 106 smoothes the illumination region intensity value of each illumination region by using the first weight defined depending on a positional relationship among the illumination regions, and calculates the second weight 107 with respect to each illumination region, the second weight 107 having a value which becomes larger as the smoothed intensity value of each illumination region becomes smaller than the illumination region intensity value of each illumination region (S203).

Figure 4:
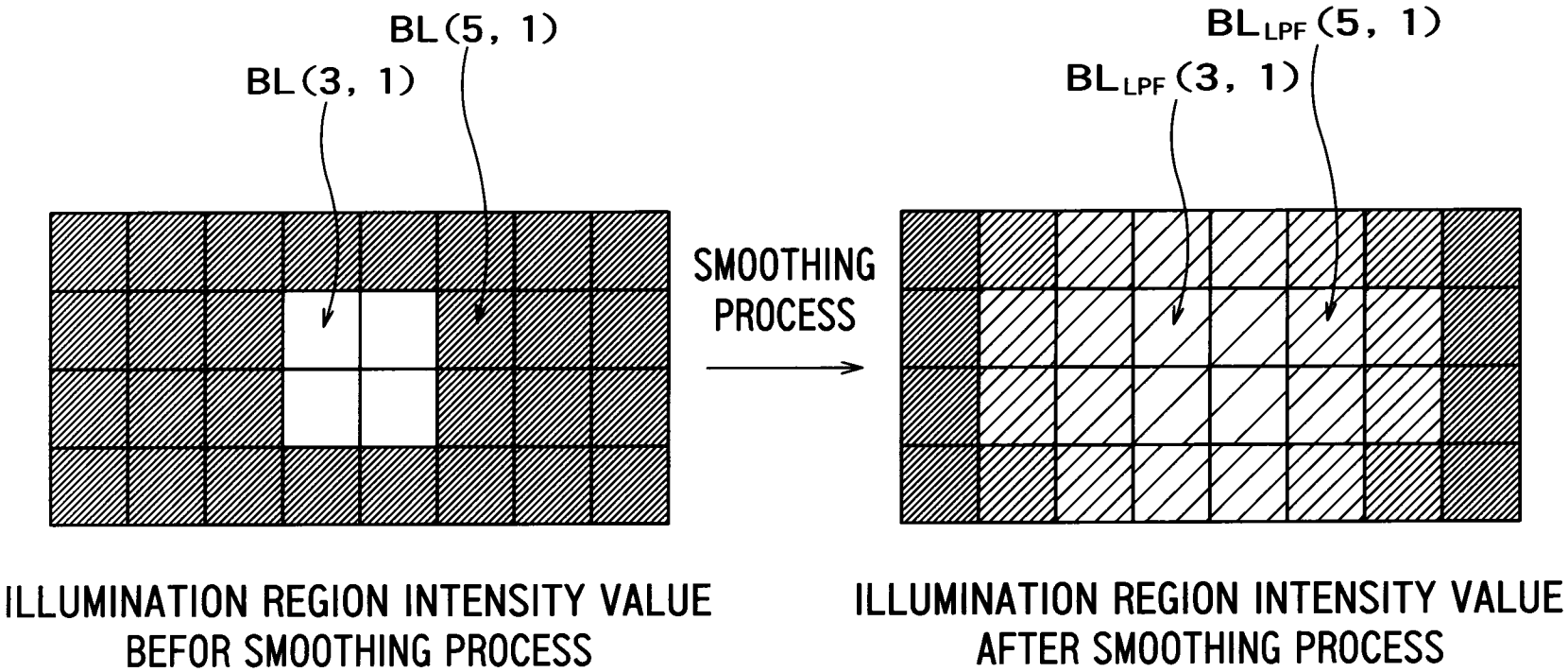
FIG. 4 is a diagram explaining a calculation method of a second weight.

A calculation method of the second weight will be concretely explained by using FIG. 4. FIG. 4 shows an example in which the display region is formed of totally 32 illumination regions obtained by multiplying 8 illumination regions in the horizontal direction and 4 illumination regions in the vertical direction. The illumination region intensity value 105 is expressed as BL(m,n). Note that m shows an index of the illumination region in the horizontal direction, n shows an index of the illumination region in the vertical direction, and the corresponding illumination region is expressed as an illumination region (m,n).

First, the weight calculator 106 performs a spatial smoothing process on the illumination region intensity value BL(m, n) by using only the first weight w1, which is a spatial weight previously retained. In comparison with the illumination region intensity value BL(m,n), the intensity value of the smoothed illumination region is represented as $BL_{LPF}(m,n)$. $BL_{LPF}(m,n)$ is calculated based on Formula (2) by using the illumination region intensity value BL(m,n) and the first weight w1. That is, based on a filter in which the first weight w1 is stored in each element of a matrix having a size H in the horizontal direction and a size V in the vertical direction, a total of weighted illumination region intensity value in each of a target illumination region (m,n) and its surrounding illumination regions is calculated, thereby the illumination region intensity value BL(m,n) being smoothed. The smoothing process is performed on the illumination region intensity value of every illumination region (m=0 to 7, n=0 to 3).

$$BL_{LPF}(m,n)=\sum_{j=0}^{V-1}\sum_{i=0}^{H-1} w1(i,j)\cdot BL\left(m-\frac{(H-1)}{2}+i,\ n-\frac{(V-1)}{2}+j\right) \quad (2)$$

(Each of $H$ and $V$ is an odd number)

Note that H and V represent the size of the smoothing filter in the horizontal direction and that in the vertical direction respectively.

Next, BL(m,n) and $BL_{LPF}(m,n)$, which are the values obtained before and after the smoothing process respectively, are compared to each other, and a value G(m,n) showing the reduction level of the intensity value due to the smoothing process is calculated based on Formulas (3).

$$\text{When } BL(m,n)\le BL_{LPF}(m,n),\ \text{then } G(m,n)=1 \quad (3)$$

$$\text{When } BL(m,n)> BL_{LPF}(m,n),\ \text{then } G(m,n)=\frac{BL(m,n)}{BL_{LPF}(m,n)}$$

In the example of FIG. 4, the intensity value of the illumination region (3,1) is reduced by the smoothing process.

$$\text{Since } BL(3,1)> BL_{LPF}(3,1),\ G(3,1)=\frac{BL(3,1)}{BL_{LPF}(3,1)}.$$

On the other hand, the luminance value of the illumination region (5,1) is increased by the smoothing process. Since $BL(5,1)\le BL_{LPF}(5,1)$, G(5,1)=1.

Further, the weight calculator 106 calculates an output w2(*m,n*) with respect to each illumination region by inputting G(m,n) representing the reduction level of the intensity value due to the spatial smoothing process into a function F, as shown in Formula (4). The output w2(*m,n*) serves as the second weight 107, which is a weight concerning the reduction in the intensity value. The weight calculator 106 transmits the second weight 107 (w2(*m,n*)) calculated with respect to each illumination region to the intensity value corrector 108.

$$w2(m,n)=F(G(m,n)) \quad (4)$$

Figure 5:
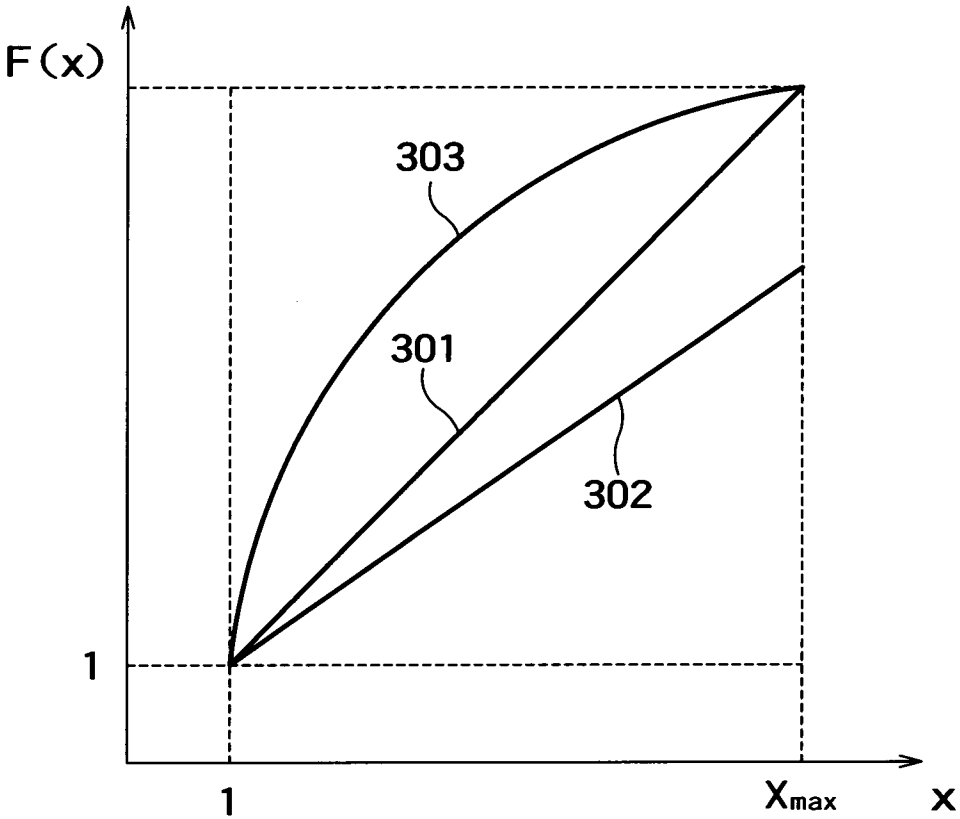
FIG. 5 is a diagram showing an example of a function.

FIG. 5 shows an example of the function F. G(m,n) having a value within a range of the minimum value 1 to the maximum value Xmax is converted into w2(*m,n*) by one of various input output characteristics as shown in functions F 301 to 303. The input output characteristic of the function F may be linear or nonlinear, and the output F(G(m,n)) may exceed Xmax, which is a maximum input value. Note that the function F is a monotone increasing function. The function 301 is a function for outputting the inputted G(m,n) as w2(*m,n*) having the same value. The function 302 is a function for outputting the inputted G(m,n) having a smaller value, and the function 303 is a function for outputting the inputted G(m,n) having a larger value. In the function 301, the value of the inputted G(m,n) and the value of the outputted w2(*m,n*) are the same, and thus the calculated G(m,n) may be used directly as w2(*m,n*) without using the function. Which function should be used is previously determined in a design stage depending on the characteristics of the backlight to be used, for example.

In the example of FIG. 5, G(m,n) is converted into w2(*m,n*) by the function F, but w2(*m,n*) may be calculated by referring to a lookup table in which the correspondence between G(m, n) and F(m,n) is previously determined.

As stated above, the value obtained by spatially smoothing the illumination region intensity value of the illumination region changes depending on the magnitude relationship between the illumination region intensity value of the illumination region and the intensity values of its surrounding illumination regions. Accordingly, by calculating G(m,n) showing the reduction level of the intensity value based on the spatial smoothing process, the relative relationship between the illumination region intensity value of each illumination region and the intensity values of its surrounding illumination regions can be estimated. As a result, when the illumination region intensity values of the surrounding illumination regions are larger than the illumination region intensity value of the illumination region, the weight w2(*m,n*) becomes small since the intensity value is not reduced due to the smoothing process. On the other hand, as the illumination region intensity values of the surrounding illumination regions become smaller, the weight w2$(m,n)$ becomes large since the intensity value of the illumination region is greatly reduced due to the smoothing process.

Next, the intensity value corrector 108 calculates the light source intensity value 109 by correcting the illumination region intensity value 105 of each illumination region by using the first weight w1 and the second weight 107 calculated by the weight calculator 106 (S204).

The correction method of the illumination region intensity value 105 will be concretely explained. The intensity value corrector 108 calculates a light source intensity value $BL_{out}$ (m,n) by spatially smoothing an illumination region intensity BL(m,n) by using the first weight w1 and the second weight w2, as shown in Formula (5). That is, after weighting (multiplying) the illumination region intensity value of each illumination region by the second weight w2, the smoothing process as shown in Formula (2) is performed by using the first weight w1. The intensity value corrector 108 transmits the light source intensity value 109 $BL_{out}$(m,n) calculated with respect to each illumination region (m=0 to 7, and n=0 to 3 in FIG. 4) to the intensity distribution estimator 110 and the light source controller 114.

$$BL_{out}(m,n)=\sum_{j=0}^{V-1}\sum_{i=0}^{H-1} w1(i,j)\cdot w2\left(m-\frac{(H-1)}{2}+i,\ n-\frac{(V-1)}{2}+j\right)\cdot BL\left(m-\frac{(H-1)}{2}+i,\ n-\frac{(V-1)}{2}+j\right) \tag{5}$$

The intensity distribution estimator 110 estimates the intensity 111 of light incident on each pixel position of the liquid crystal panel 120 when each light source irradiates light on the liquid crystal panel 120 in accordance with the light source intensity value 109 thereof (S205). Concretely, convolution operation as shown in Formula (6) is performed on the light source intensity value 109 of each illumination region and previously given luminescence intensity distribution of the light source, so that W(x,y), which shows the intensity distribution 111 of the light source at each position (x,y), is obtained.

$$W(x,y)=\sum_{j=0}^{N-1}\sum_{i=0}^{M-1} P(i,j)\cdot BL_{out}\left(x-\frac{(M-1)}{2}+i,\ y-\frac{(N-1)}{2}+j\right) \tag{6}$$

(Each of $M$ and $N$ is an odd number)

Note that M and N represent the size of the luminescence intensity distribution in the horizontal direction and that in the vertical direction respectively, $BL_{out}$(x,y) shows the light source intensity of a region including a coordinate (x,y), and P(i,j) shows the intensity value of the luminescence intensity distribution at a position (i,j). Further, as to the peripheral region of the image, W(x,y), which shows the light source intensity distribution 111, is obtained by performing the convolution operation of Formula (6) while specularly reflecting the light source intensity value 109.

The light source intensity distribution 111 calculated by the intensity distribution estimator 110 is inputted into the signal corrector 112.

Next, the signal corrector 112 corrects the input video signal 103 in accordance with the intensity distribution 111 to obtain the corrected video signal 113 (S206). RGB values of the pixel at a position (x,y) in the input video signal 103 are defined as $R_{in}$(x,y), $G_{in}$(x,y), and $B_{in}$(x,y) respectively. Generally, RGB values $D_R$(x,y), $D_G$(x,y), $D_B$(x,y) displayed on the liquid crystal panel 120 are expressed as in Formulas (7) by using $T_R$(x,y), $T_G$(x,y), and $T_B$(x,y), each of which shows the transmissivity of the liquid crystal panel 120 with respect to each color component, based on the intensity value W(x,y) at the position (x,y) of the intensity distribution 111.

$$D_R(x,y)=T_R(x,y)\times W(x,y)$$

$$D_G(x,y)=T_G(x,y)\times W(x,y)$$

$$D_B(x,y)=T_B(x,y)\times W(x,y) \tag{7}$$

Since $D_R$(x,y)=$R_{in}$(x,y), $D_G$(x,y)=$G_{in}$(x,y), and $D_B$(x,x)=$B_{in}$(x,y), $R_{in}$(x,y), $G_{in}$(x,y), and $B_{in}$(x,y) are expressed as in Formulas (8).

$$R_{in}(x,y)=T_R(x,y)\times W(x,y)$$

$$G_{in}(x,y)=T_G(x,y)\times W(x,y)$$

$$B_{in}(x,y)=T_B(x,y)\times W(x,y) \tag{8}$$

Therefore, corrected transmissivity $R_{TR}$(x,y), $G_{TR}$(x,y), and $B_{TR}$(x,y) for displaying $R_{in}$(x,y), $G_{in}$(x,y), and $B_{in}$(x,y) are calculated as in Formulas (9).

$$R_{TR}(x,y)=\frac{R_{in}(x,y)}{W(x,y)} \tag{9}$$

$$G_{TR}(x,y)=\frac{G_{in}(x,y)}{W(x,y)}$$

$$B_{TR}(x,y)=\frac{B_{in}(x,y)}{W(x,y)}$$

The corrected transmissivity may be obtained by Formulas (9) or by referring to a lookup table in which the correspondence among the input gray-scale level value, the light source intensity distribution value, and the transmissivity is previously determined.

Gray-scale level values of a corrected image displayed on the liquid crystal panel 120 in accordance with the corrected transmissivity ($R_{TR}$(x,y), $G_{TR}$(x,y), $B_{TR}$(x,y)) are defined as ($R_{out}$(x,y), $G_{out}$(x,y), and $B_{out}$(x,y)). The gray-scale level value $R_{out}$(x,y) of the corrected image is obtained by performing inverse gamma conversion on the corrected transmissivity $R_{TR}$(x,y) as shown in Formula (10). (The same can be applied to $G_{out}$(x,y) and $B_{out}$(x,y).)

$$R_{out}(x,y)=(R_{TR}(x,y))^{\frac{1}{\gamma}}\times 255 \tag{10}$$

When ($R_{out}$(x,y), $G_{out}$(x,y), $B_{out}$(x,y)) exceeds a displayable range of the liquid crystal panel 120, ($R_{out}$(x,y), $G_{out}$(x,y), $B_{out}$(x,y)) is fixed at a maximum displayable value ($R_{out}$MAX, $G_{out}$MAX, $B_{out}$MAX) (hereinafter referred to as a clipping process).

Therefore, when a gray-scale level value (corrected gray-scale level value) in view of the clipping process is defined as ($R'_{out}$(x,y), $G'_{out}$(x,y), $B'_{out}$(x,y)), ($R'_{out}$(x,y), $G'_{out}$(x,y), $B'_{out}$(x,y)) can be obtained by the following formulas.

When $R_{out}>R_{outMAX}$, then $R'_{out}(x,y)=R_{outMAX}$

When $G_{out}>G_{outMAX}$, then $G'_{out}(x,y)=G_{outMAX}$

When $B_{out}>B_{outMAX}$, then $B'_{out}(x,y)=B_{outMAX}$

Further, the following formulas can be applied.

When $R_{out} \leq R_{outMAX}$, then $R'_{out}(x,y)=R_{out}(x,y)$

When $G_{out} \leq G_{outMAX}$, then $G'_{out}(x,y)=G_{out}(x,y)$

When $B_{out} \leq B_{outMAX}$, then $B'_{out}(x,y)=B_{out}(x,y)$

Note that the gray-scale level value can be corrected by rounding the gray-scale level value ($R_{out}$(x,y), $G_{out}$(x,y), $B_{out}$(x,y)) in a displayable range in accordance with the following gray-scale characteristics:

(1) a gray-scale characteristic in which a curve is rounded and the inclination of the curve becomes more gradual as the gray-scale level value becomes larger; and (2) a gray-scale characteristic in which a curve is linear when the gray-scale level value is small and a curve is rounded and the inclination of the curve becomes more gradual as the gray-scale level value becomes larger when the gray-scale level value is large.

In the present embodiment, the gray-scale level value is separately corrected with respect to each color component, but the gray-scale level value may be corrected retaining the color ratio of each color component so that the image can be displayed retaining the RGB ratio of the input video signal.

The signal corrector 112 transmits the corrected gray-scale level value ($R'_{out}$(x,y), $G'_{out}$(x,y), $B'_{out}$(x,y)) of each pixel to the liquid crystal controller 115 as the corrected video signal 113.

The liquid crystal controller 115 generates the liquid crystal control signal 117 for controlling the transmissivity of the liquid crystal panel with respect to each pixel based on the corrected video signal 113 from the signal corrector 112 and transmits the liquid crystal control signal 117 to the liquid crystal panel 120, and the liquid crystal panel 120 sets the transmissivity of the liquid crystal panel with respect to each pixel of in accordance with the liquid crystal control signal 117 (S207). The light source controller 114 generates the light source intensity control signal 116 for making each light source emit light with the intensity shown by the light source intensity value 109 transmitted from the intensity value corrector 108 and transmits the light source intensity control signal 116 to the backlight 119, and the backlight 119 makes each light source emit light in accordance with the light source intensity control signal 116 (S207). The light irradiated by each light source is modulated depending on the transmissivity of the liquid crystal panel 120 with respect to each pixel, by which a video picture depending on the corrected video signal 113 is displayed in the display region of the liquid crystal panel 120 (S207).

Here, an effect of the present embodiment will be explained. FIG. 6 shows 6×6 illumination regions as an example. In FIG. 6, the value of each illumination region is the illumination region intensity value (representative intensity value) of each illumination region.

When the illumination region intensity values as shown in FIG. 6(*a*) are smoothed by using a Gaussian filter, smoothed intensity values are as shown in FIG. 6(*b*). Note that coefficients as shown in FIG. 6(*h*) are used as the Gaussian coefficients (first weights). In FIG. 6(*b*), the intensity values (255) of the central illumination regions are considerably reduced. Further, the intensity values of the illumination regions each originally having an intensity value of 50 are increased, and the intensity values are smoothly changed from the center to the outside. In this manner, when the smoothing process is performed by using only spatial weights as typified by the Gaussian filter, if dark illumination regions having low intensity values are dominant while bright illumination regions having high intensity values are partially mixed as shown in the example of FIG. 6(*a*), the intensity values of the bright illumination region are considerably reduced due to the smoothing process and the reduction in the intensity values causes deterioration of image quality such as gray-scale level saturation and color drift.

Further, a smoothing process using a conventional method will be considered. In the conventional method, the intensity value of each illumination region is corrected to be increased while keeping the difference or ratio between the intensity values of adjacent illumination regions within a threshold value. FIG. 6(*c*) shows a result obtained by correcting the intensity value of each illumination region so that corrected intensity values of the most peripheral illumination regions become approximately the original intensity values (50 to 51) by using a difference threshold value A. Similarly, FIG. 6(*d*) shows a result obtained by correcting the intensity value of each illumination region so that corrected intensity values of the most peripheral illumination regions become approximately the original intensity values (50 to 51) by using a ratio threshold value B.

Figure 7:
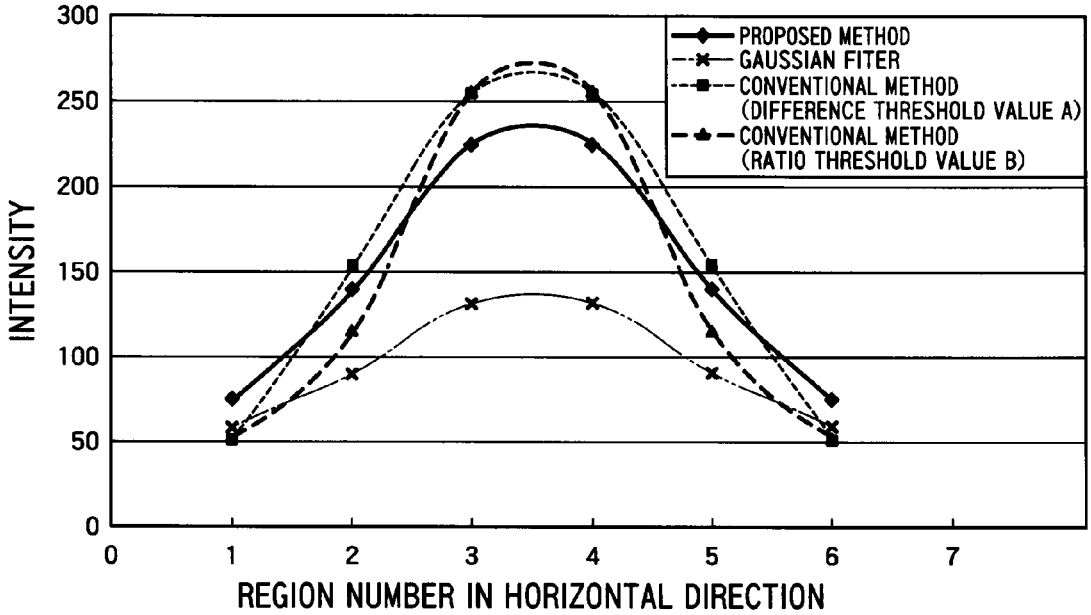
FIG. 7 is a diagram explaining an effect of the first embodiment.
Figure 7:
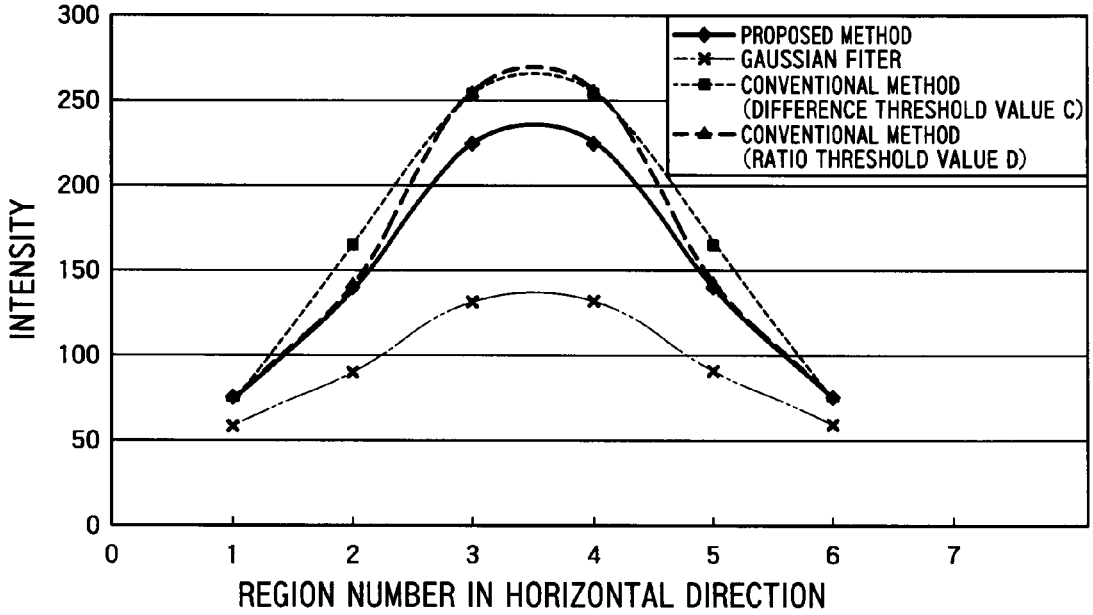

On the other hand, FIG. 6(*g*) shows a result obtained by correcting the intensity value of each illumination region in accordance with the present embodiment (proposed method). In the proposed method, the Gaussian coefficients of FIG. 6(*h*) are used as the first weights based on the spatial positions of the illumination regions. FIG. 7(*a*) shows the changes in the intensity of the illumination regions situated in the horizontal direction and in the third line in the vertical direction in each of FIG. 6(*c*), FIG. 6(*d*), and FIG. 6(*g*). When referring to FIG. 7(*a*), in the conventional method, the intensity of the illumination regions is changed with a equal difference or equal ratio when the difference threshold value or the ratio threshold value is used, and thus the change from the intensity (maximum value) of the central illumination regions to the intensity (minimum value) of the most peripheral illumination regions becomes steep. On the other hand, in the proposed method, the intensity (maximum value) of the central illumination regions is not considerably reduced while the intensity of its surrounding illumination regions is increased, and thus the intensity smoothly changes depending on the distance from the central illumination region.

As different examples, FIG. 6(*e*) and FIG. 6(*f*) show results obtained by correcting the intensity value of each illumination region in the conventional method by using a difference threshold value C and a ratio threshold value D, in which the corrected intensity values of the most peripheral illumination regions ("74" in FIG. 6(*g*)) in the conventional method is corrected to become approximately equivalent to the corrected intensity values of the most peripheral illumination regions in the proposed method. FIG. 7(*b*) shows the changes in the intensity of the illumination regions situated in the horizontal direction and in the third line in the vertical direction in each of FIG. 6(*e*), FIG. 6(*f*), and FIG. 6(*g*). When referring to FIG. 7(*b*), the intensity values of the most peripheral illumination regions in each method are equivalent, but the intensity tends to totally become large since, in the conventional method, the change between the intensity of the central illumination regions and the intensity of the most peripheral illumination regions is achieved with a equal difference or equal ratio even when any one of the difference threshold value C and the ratio threshold value D is used. On the other hand, in the proposed method, the intensity of the central illumination regions is not considerably reduced and the intensity of each illumination region is smoothly changed toward the intensity of the most peripheral illumination regions, by which redundant light emitted from the light source can be prevented.

As stated above, according to the present embodiment, in an input image having bright and dark areas, the intensity of each illumination region can be smoothed without considerably reducing the intensity values of the illumination regions having large intensity values and without excessively increasing the intensity values of the illumination regions having small intensity values, and an image and a video picture without uneven brightness can be displayed with low power consumption.

Second Embodiment

Figure 8:
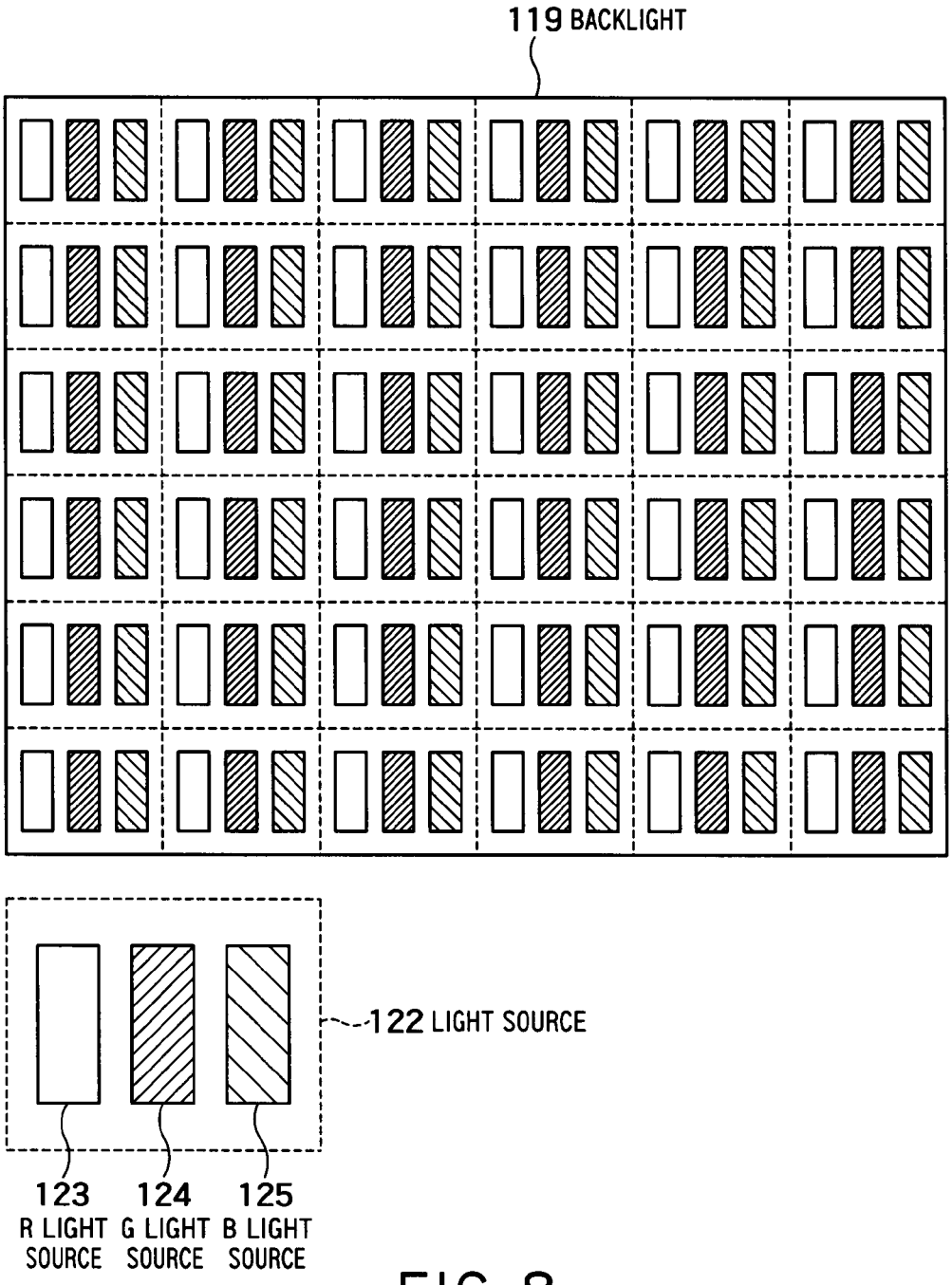
FIG. 8 is a diagram showing a detailed structure of a backlight according to a second embodiment.

A second embodiment will be explained. The present embodiment shows an example in which each light source in the backlight has a plurality of colored light sources each of which can be separately controlled. FIG. 8 shows the backlight 119 according to the present embodiment. In the first embodiment, as shown in FIG. 2, the color of light emitted from every light source in the backlight 119 is white. On the other hand, in the present embodiment, each light source 122 has an R light source 123, a G light source 124, and a B light source 125, and the intensity of each of the R, G, and B colored light source can be individually controlled. Note that in the present embodiment, RGB three color light sources are employed, but four or more color light sources may be employed.

In the present embodiment, similarly to the first embodiment, regions obtained by virtually dividing a display region of the liquid crystal panel 120 based on a spatial placement of the light sources 122 in the backlight 119 are defined as illumination regions. Each illumination region is related to a different light source 122 (in the closest position).

The intensity value calculator 104 calculates a maximum value of each color component based on the signal value of each pixel in the illumination region of the input video signal 103, the maximum value being calculated as the illumination region intensity value 105 (representative intensity value) 105 of each colored light source. The illumination region intensity value (representative intensity value) of each color component in the illumination region may be a value obtained by multiplying a central lightness value between a maximum lightness value and a minimum lightness value of the pixels in each illumination region by a constant, or a mean, mode, or median value of the intensity values of the pixels in each illumination region.

The weight calculator 106 smoothes the representative intensity value of each illumination region by using the first weight defined depending on a positional relationship among the illumination regions with respect to each color component, and calculates the second weight 107 of each color component with respect to each illumination region, the second weight 107 having a value which becomes larger as the smoothed intensity value of each illumination region becomes smaller than the representative intensity value of each illumination region. A concrete calculation method of the weight is as explained in the first embodiment.

The intensity value corrector 108 corrects the intensity value of each color component in the illumination region by using the first weight and the second weight 107 calculated by the weight calculator 106 with respect to each color component, and calculates the light source intensity value 109. A concrete correction method of the intensity value is as explained in the first embodiment.

The intensity distribution estimator 110 estimates, with respect to each color component, intensity 111 of light incident on each pixel position of the liquid crystal panel 120 when the backlight 119 irradiates light on the liquid crystal panel 120 with the intensity depending on the light source intensity value 109. Concretely, convolution operation as shown in Formula (11) is performed on the light source intensity value 109 of each illumination region and previously given luminescence intensity distribution of the light source, so that $R_{BL}(x,y)$, $G_{BL}(x,y)$, and $B_{BL}(x,y)$, each of which is the intensity distribution 111 of the light source of each color component at each position (x,y), is obtained.

$$R_{BL}(x, y) = \sum_{j=0}^{N-1}\sum_{i=0}^{M-1} P_R(i, j)\cdot BL_{Rout}\left(x - \frac{(M-1)}{2} + i,\ y - \frac{(N-1)}{2} + j\right) \tag{11}$$

$$G_{BL}(x, y) = \sum_{j=0}^{N-1}\sum_{i=0}^{M-1} P_G(i, j)\cdot BL_{Gout}\left(x - \frac{(M-1)}{2} + i,\ y - \frac{(N-1)}{2} + j\right)$$

$$B_{BL}(x, y) = \sum_{j=0}^{N-1}\sum_{i=0}^{M-1} P_B(i, j)\cdot BL_{Bout}\left(x - \frac{(M-1)}{2} + i,\ y - \frac{(N-1)}{2} + j\right)$$

(Each of $M$ and $N$ is an odd number)

Note that M and N represent the size of the luminescence intensity distribution in the horizontal direction and that in the vertical direction respectively, each of $BL_{Rout}(x,y)$, $BL_{Gout}(x,y)$, and $BL_{Bout}(x,y)$ shows the light source intensity of each color component of a region including a coordinate (x,y), and each of $P_R(i,j)$, $P_G(i,j)$, and $P_B(i,j)$ shows the intensity value of the luminescence intensity distribution of each color component at a position (i,j). Further, as to the peripheral region of the image, $R_{BL}(x,y)$, $G_{BL}(x,y)$, and $B_{BL}(x,y)$, each of which shows the light source intensity distribution 111, are obtained by performing the convolution operation of Formula (11) while specularly reflecting the light source intensity value 109. The light source intensity distribution 111 calculated by the intensity distribution estimator 110 is inputted into the signal corrector 112.

The signal corrector 112 corrects the input video signal 103 in accordance with the intensity distribution 111 to obtain the corrected video signal 113. RGB values of the pixel at a position (x,y) in the input video signal 103 are defined as $R_{in}(x,y)$, $G_{in}(x,y)$, and $B_{in}(x,y)$ respectively. Generally, RGB values $D_R(x,y)$, $D_G(x,y)$, $D_B(x,y)$ displayed on the liquid crystal panel 120 can be expressed by Formula (12) by using $T_R(x,y)$, $T_G(x,y)$, and $T_B(x,y)$, each of which shows the transmissivity of the liquid crystal panel 120 with respect to each color component, based on the intensity values $R_{BL}(x,y)$, $G_{BL}(x,y)$, and $B_{BL}(x,y)$ at the position (x,y) of the intensity distribution 111.

$$\begin{pmatrix} D_R(x, y) \\ D_G(x, y) \\ D_B(x, y) \end{pmatrix} = \begin{pmatrix} k11 & k12 & k13 \\ k21 & k22 & k23 \\ k31 & k32 & k33 \end{pmatrix} \cdot \begin{pmatrix} T_R(x, y) \\ T_G(x, y) \\ T_B(x, y) \end{pmatrix} \tag{12}$$

Note that each of the following coefficients k11 to k33 represents the intensity when the transmissivity of the liquid crystal panel 120 with respect to each pixel is a maximum value based on the light source intensity $R_{BL}(x,y)$, $G_{BL}(x,y)$, and $B_{BL}(x,y)$.

k11: The intensity of light with respect to the R component when the light is transmitted through the subpixel R.

k12: The intensity of light with respect to the R component when the light is transmitted through the subpixel G.

k13: The intensity of light with respect to the R component when the light is transmitted through the subpixel B.

k21: The intensity of light with respect to the G component when the light is transmitted through the subpixel R.

k22: The intensity of light with respect to the G component when the light is transmitted through the subpixel G.

k23: The intensity of light with respect to the G component when the light is transmitted through the subpixel B.

k31: The intensity of light with respect to the B component when the light is transmitted through the subpixel R.

k32: The intensity of light with respect to the B component when the light is transmitted through the subpixel G.

k33: The intensity of light with respect to the B component when the light is transmitted through the subpixel B.

Since $D_R(x,y)=R_{in}(x,y)$, $D_G(x,y)=G_{in}(x,y)$, and $D_B(x,y)=B_{in}(x,y)$, when the corrected transmissivity of the liquid crystal panel 120 for displaying $R_{in}(x,y)$, $G_{in}(x,y)$, and $B_{in}(x,y)$ is defined as $R_{TR}(x,y)$, $G_{TR}(x,y)$, and $B_{TR}(x,y)$, the relationship between $(R_{in}(x,y), G_{in}(x,y), B_{in}(x,y))$ and $(R_{TR}(x,y), G_{TR}(x,y), B_{TR}(x,y))$ can be expressed as in Formula (13).

$$\begin{pmatrix} R_{in}(x,y) \\ G_{in}(x,y) \\ B_{in}(x,y) \end{pmatrix} = \begin{pmatrix} k11 & k12 & k13 \\ k21 & k22 & k23 \\ k31 & k32 & k33 \end{pmatrix} \begin{pmatrix} R_{TR}(x,y) \\ G_{TR}(x,y) \\ B_{TR}(x,y) \end{pmatrix} \tag{13}$$

Therefore, $(R_{TR}(x,y), G_{TR}(x,y), B_{TR}(x,y))$ can be calculated as in Formula (14).

$$\begin{pmatrix} R_{TR}(x,y) \\ G_{TR}(x,y) \\ B_{TR}(x,y) \end{pmatrix} = \begin{pmatrix} k11 & k12 & k13 \\ k21 & k22 & k23 \\ k31 & k32 & k33 \end{pmatrix}^{-1} \begin{pmatrix} R_{in}(x,y) \\ G_{in}(x,y) \\ B_{in}(x,y) \end{pmatrix} \tag{14}$$

The corrected transmissivity may be obtained by Formula (14) or by referring to a lookup table in which the correspondence among the input gray-scale level value, the light source intensity distribution value, and the transmissivity is previously determined. In Formula (12), the signal displayed on the liquid crystal panel 120 is expressed by using $D_R(x,y)$, $D_G(x,y)$, and $D_B(x,y)$ based on RGB components. When the signal displayed on the liquid crystal panel 120 is expressed by using $D_X(x,y)$, $D_Y(x,y)$, and $D_Z(x,y)$ based on XYZ components, $D_X(x,y)$, $D_Y(x,y)$, and $D_Z(x,y)$ can be expressed by Formula (12) by using $T_R(x,y)$, $T_G(x,y)$, and $T_B(x,y)$, each of which shows the transmissivity of the liquid crystal panel 120 with respect to each color component, based on the intensity values $R_{BL}(x,y)$, $G_{BL}(x,y)$, and $B_{BL}(x,y)$ at the position (x,y) of the intensity distribution 111.

$$\begin{pmatrix} D_X(x,y) \\ D_Y(x,y) \\ D_Z(x,y) \end{pmatrix} = \begin{pmatrix} l11 & l12 & l13 \\ l21 & l22 & l23 \\ l31 & l32 & l33 \end{pmatrix} \cdot \begin{pmatrix} T_R(x,y) \\ T_G(x,y) \\ T_B(x,y) \end{pmatrix} \tag{12}'$$

Note that each of the following coefficients l11 to l33 represents the intensity when the transmissivity of the liquid crystal panel 120 with respect to each pixel is a maximum value based on the light source intensity $R_{BL}(x,y)$, $G_{BL}(x,y)$, and $B_{BL}(x,y)$.

l11: The intensity of light with respect to the X component when the light is transmitted through the subpixel R.

l12: The intensity of light with respect to the X component when the light is transmitted through the subpixel G.

l13: The intensity of light with respect to the X component when the light is transmitted through the subpixel B.

l21: The intensity of light with respect to the Y component when the light is transmitted through the subpixel R.

l22: The intensity of light with respect to the Y component when the light is transmitted through the subpixel G.

l23: The intensity of light with respect to the Y component when the light is transmitted through the subpixel B.

l31: The intensity of light with respect to the Z component when the light is transmitted through the subpixel R.

l32: The intensity of light with respect to the Z component when the light is transmitted through the subpixel G.

l33: The intensity of light with respect to the Z component when the light is transmitted through the subpixel B.

When $D_X(x,y)=X_{in}(x,y)$, $D_Y(x,y)=Y_{in}(x,y)$, and $D_Z(x,y)=Z_{in}(x,y)$ and when the corrected transmissivity of the liquid crystal panel 120 for displaying $X_{in}(x,y)$, $Y_{in}(x,y)$, $Z_{in}(x,y)$ is defined as $R_{TR}(x,y)$, $G_{TR}(x,y)$, and $B_{TR}(x,y)$, the relationship between $(X_{in}(x,y), Y_{in}(x,y), Z_{in}(x,y))$ and $(R_{TR}(x,y), G_{TR}(x,y), B_{TR}(x,y))$ can be expressed as in Formula (13)'.

$$\begin{pmatrix} X_{in}(x,y) \\ Y_{in}(x,y) \\ Z_{in}(x,y) \end{pmatrix} = \begin{pmatrix} l11 & l12 & l13 \\ l21 & l22 & l23 \\ l31 & l32 & l33 \end{pmatrix} \begin{pmatrix} R_{TR}(x,y) \\ G_{TR}(x,y) \\ B_{TR}(x,y) \end{pmatrix} \tag{13}'$$

Therefore, $(R_{TR}(x,y), G_{TR}(x,y), B_{TR}(x,y))$ can be calculated as in Formula (14)'.

$$\begin{pmatrix} R_{TR}(x,y) \\ G_{TR}(x,y) \\ B_{TR}(x,y) \end{pmatrix} = \begin{pmatrix} l11 & l12 & l13 \\ l21 & l22 & l23 \\ l31 & l32 & l33 \end{pmatrix}^{-1} \begin{pmatrix} X_{in}(x,y) \\ Y_{in}(x,y) \\ Z_{in}(x,y) \end{pmatrix} \tag{14}'$$

The corrected transmissivity may be obtained by Formula (14)' or by referring to a lookup table in which the correspondence among the input gray-scale level value, the light source intensity distribution value, and the transmissivity is previously determined. In the present embodiment, the explanation is made on an example in which RGB three color light sources are arranged, but even when four or more colored light sources are arranged, the corrected transmissivity can be calculated based on the light source intensity of each color by expressing the video signal in XYZ space as shown in Formulas (12)' to (14)'.

Gray-scale level values of a corrected image displayed on the liquid crystal panel 120 in accordance with the corrected transmissivity $(R_{TR}(x,y), G_{TR}(x,y), B_{TR}(x,y))$ are defined as $(R_{out}(x,y), G_{out}(x,y), B_{out}(x,y))$. The gray-scale level value $R_{out}(x,y)$ of the corrected image is obtained by performing inverse gamma conversion on the corrected transmissivity $R_{TR}(x,y)$ as shown in Formula (15). (The same can be applied to $G_{out}(x,y)$ and $B_{out}(x,y)$.)

$$R_{out}(x, y) = (R_{TR}(x, y))^{\frac{1}{\gamma}} \times 255 \quad (15)$$

When ($R_{out}(x,y)$, $G_{out}(x,y)$, $B_{out}(x,y)$) exceeds a displayable range of the liquid crystal panel 120, ($R_{out}(x,y)$, $G_{out}(x,y)$, $B_{out}(x,y)$) is fixed at a maximum displayable value ($R_{out}$-MAX, $G_{out}$MAX, $B_{out}$MAX) (hereinafter referred to as a clipping process).

Therefore, when a gray-scale level value (corrected gray-scale level value) in view of the clipping process is defined as ($R'_{out}(x,y)$, $G'_{out}(x,y)$, $B'_{out}(x,y)$), ($R'_{out}(x,y)$, $G'_{out}(x,y)$, $B'_{out}(x,y)$) can be obtained by the following formulas.

When $R_{out}>R_{outMAX}$, then $R'_{out}(x,y)=R_{outMAX}$

When $G_{out}>G_{outMAX}$, then $G'_{out}(x,y)=G_{outMAX}$

When $B_{out}>B_{outMAX}$, then $B'_{out}(x,y)=B_{outMAX}$

Further, the following formulas can be applied.

When $R_{out}\leq R_{outMAX}$, then $R'_{out}(x,y)=R_{out}(x,y)$

When $G_{out}\leq G_{outMAX}$, then $G'_{out}(x,y)=G_{out}(x,y)$

When $B_{out}\leq B_{outMAX}$, then $B'_{out}(x,y)=B_{out}(x,y)$

Note that the gray-scale level value can be corrected by rounding the gray-scale level value in a displayable range in accordance with the following gray-scale characteristics:

(1) a gray-scale characteristic in which a curve is rounded and the inclination of the curve becomes more gradual as the gray-scale level value becomes larger; and (2) a gray-scale characteristic in which a curve is linear when the gray-scale level value is small and a curve is rounded and the inclination of the curve becomes more gradual as the gray-scale level value becomes larger when the gray-scale level value is large.

In the present embodiment, the gray-scale level value is separately corrected with respect to each color component, but the gray-scale level value may be corrected retaining the color ratio of each color component so that the image can be displayed retaining the RGB ratio of the input video signal.

The signal corrector 112 transmits the corrected gray-scale level value ($R'_{out}(x,y)$, $G'_{out}(x,y)$, $B'_{out}(x,y)$) of each pixel to the liquid crystal controller 115 as the corrected video signal 113.

The liquid crystal controller 115 generates the liquid crystal control signal 117 for controlling the transmissivity of the liquid crystal panel with respect to each pixel based on the corrected video signal 113 from the signal corrector 112 and transmits the liquid crystal control signal 117 to the liquid crystal panel 120 in order to control the modulation of the liquid crystal panel 120. The liquid crystal panel 120 modulates light emitted from the backlight 119 depending on the liquid crystal control signal 117 to display a video picture corresponding to the corrected video signal 113 in the display region. The light source controller 114 generates the light source intensity control signal 116 for making each light source emit light with the intensity shown by the light source intensity value 109 transmitted from the intensity value corrector 108 and transmits the light source intensity control signal 116 to the backlight 119 in order to control the light emitted from the backlight 119. The backlight 119 makes the colored light sources 123 to 125 of each light source 122 emit light depending on the light source intensity control signal 116.

As stated above, according to the present embodiment, in an input image having bright and dark areas, the intensity of each illumination region can be smoothed, even when the light source has a plurality of colored light sources each of which has separately controllable light intensity, without considerably reducing the intensity values of the illumination regions having large intensity values and without excessively increasing the intensity values of the illumination regions having small intensity values, and an image and a video picture without uneven brightness can be displayed with low power consumption.

Third Embodiment

Figure 9:
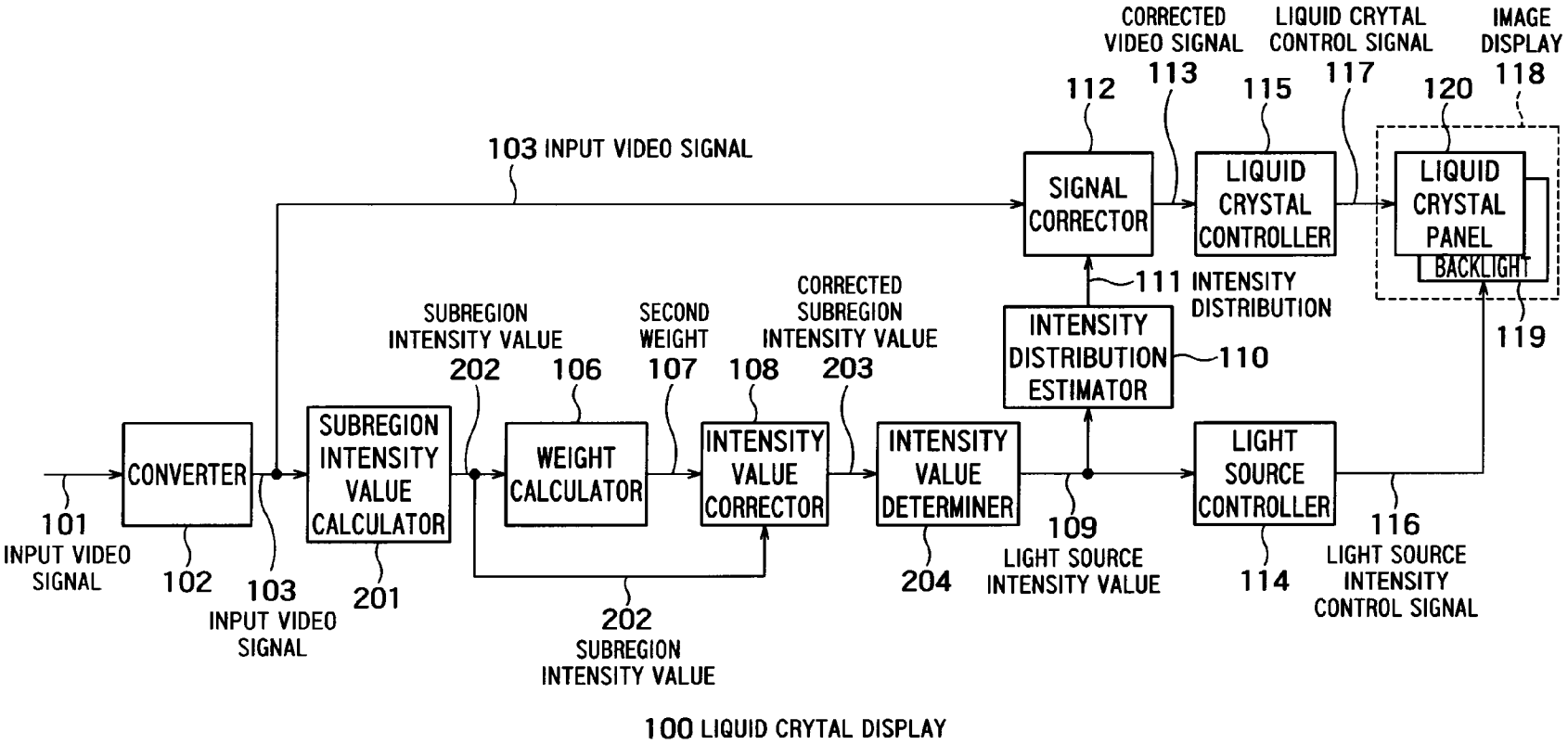
FIG. 9 is a diagram showing a liquid crystal display according to a third embodiment.

The structure of the present embodiment is characterized in further including a subregion intensity value calculator 201 and an intensity value determiner 204 in the structure of the first embodiment or the second embodiment. FIG. 9 shows a block diagram of the present embodiment.

In the first embodiment and the second embodiment, each region obtained by dividing the display region of the liquid crystal panel 120 corresponding to each light source is defined as the illumination region. In the present embodiment, each region obtained by further dividing the illumination region is defined as a subregion, the subregion intensity value is calculated depending on the pixels in the subregion, and the light source intensity value 109 of the illumination region is calculated by the subregion intensity values. Note that the subregion has a plurality of pixels, and its division number is larger than that of the illumination region. Further, in the present embodiment, each light source of the backlight may have only a white light source or a plurality of colored light sources such as RGB color light sources.

Figure 10:
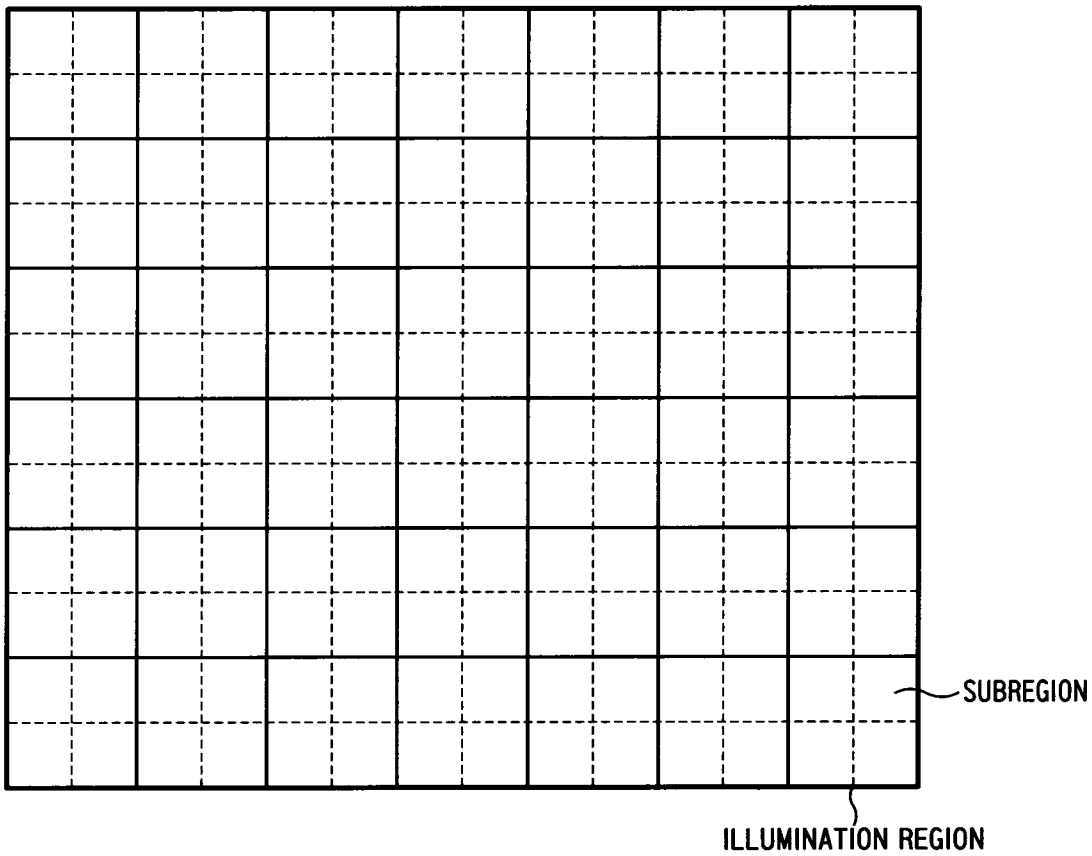
FIG. 10 is a diagram showing a relationship between an illumination region and subregions.

The relationship between the illumination region and the subregions will be explained by using FIG. 10. FIG. 10 shows that each illumination region in the display region of the liquid crystal panel 120 is further divided. In FIG. 10, each region enclosed by solid lines is the illumination region. Each region which is obtained by further dividing the illumination region and is enclosed by dotted lines is the subregion. In the example of FIG. 10, one illumination region has four subregions, but the number of subregions in the illumination region is not limited to four.

The subregion intensity value calculator 201 calculates, based on the input video signal 103, a representative value in the pixels in each subregion obtained by further dividing the illumination region as the subregion intensity value 202, and transmits the subregion intensity value 202 to the weight calculator 106 and the intensity value corrector 108. Here, the subregion intensity value 202 is defined as a maximum intensity value in the pixels in the subregion. Note that the subregion intensity value 202 (the representative value in the pixels in the subregion) may be a value obtained by multiplying a central lightness value between a maximum lightness value and a minimum lightness value of the pixels in each subregion by a constant, or a mean, mode, or median value of the intensity values of the pixels in each subregion.

The weight calculator 106 smoothes the subregion intensity value (representative intensity value) of each subregion by using the first weight defined depending on a positional relationship among the subregions, calculates the second weight 107 with respect to each subregion, and transmits the second weight 107 to the intensity value corrector 108, the second weight 107 having a value which becomes larger as the smoothed intensity value of each subregion becomes smaller than the subregion intensity value of each subregion. A concrete calculation method of the second weight 107 is as explained in the first or second embodiment.

The intensity value corrector 108 calculates a corrected subregion intensity value 203 by correcting each subregion intensity value 202 using the first weight and the second weight 107 calculated by the weight calculator 106 with respect to each subregion. That is, the corrected subregion intensity value 203 of each subregion is obtained by correcting the subregion intensity value (representative intensity value) 202 of each subregion based on the second weight 107, and by smoothing the corrected intensity value of each subregion by using the first weight. The intensity value corrector 108 transmits the corrected subregion intensity value 203 thus calculated to the intensity value determiner 204.

When the light source of each backlight 119 has a white light source, the intensity value determiner 204 determines a mean value of the subregion intensity values 202 of each subregion included in the illumination region as the light source intensity value 109 of the illumination region, and transmits the light source intensity value 109 to the intensity distribution estimator 110 and the light source controller 114. Note that the subregion intensity value of the subregion situated at the center of the illumination region may be calculated as the light source intensity value of the illumination region.

Hereinafter, the calculation method of the light source intensity will be explained based on a case where the backlight 119 has a plurality of colored light sources and the light source intensity of each color component can be separately controlled.

In an example where the illumination region is divided into four subregions as shown in FIG. 10, the intensity values of each subregion with respect to each color component are defined as (R1, G1, B1), (R2, G2, B2), (R3, G3, B3), and (R4, G4, B4) respectively. Maximum value ($R_{max}$, $G_{max}$, $B_{max}$) and mean value ($R_{ave}$, $G_{ave}$, $B_{ave}$) among the subregion intensity values in the illumination region are calculated with respect to each color component, as shown in Formulas (16) and (17).

$$R_{max}=\mathrm{MAX}(R1,R2,R3,R4)$$

$$G_{max}=\mathrm{MAX}(G1,G2,G3,G4)$$

$$B_{max}=\mathrm{MAX}(B1,B2,B3,B4) \tag{16}$$

$$R_{ave}=\mathrm{AVERAGE}(R1,R2,R3,R4)$$

$$G_{ave}=\mathrm{AVERAGE}(G1,G2,G3,G4)$$

$$B_{ave}=\mathrm{AVERAGE}(B1,B2,B3,B4) \tag{17}$$

Further, when $L_{max}=\mathrm{MAX}(R_{max}, G_{max}, B_{max})$ and $L_{ave}=\mathrm{AVERAGE}(R_{ave}, G_{ave}, B_{ave})$, the light source intensity ($BL_{Rout}$, $BL_{Gout}$, $BL_{Bout}$) of the illumination region with respect to each color component is calculated by multiplying ($R_{max}$, $G_{max}$, $B_{max}$) by the coefficient ($L_{ave}/L_{max}$) determined for each illumination region, as shown in Formulas (18).

$$BL_{Rout}=R_{max}\times(L_{ave}/L_{max})$$

$$BL_{Gout}=G_{max}\times(L_{ave}/L_{max})$$

$$BL_{Bout}=B_{max}\times(L_{ave}/L_{max}) \tag{18}$$

In the present embodiment, ($L_{ave}/L_{max}$) is used as a coefficient by which ($R_{max}$, $G_{max}$, $B_{max}$) is multiplied, but the multiplier coefficient may have another value.

Further, the light source intensity of the illumination region with respect to each color component may be determined by averaging the subregion intensity values of the subregions with respect to each color component, as shown in Formulas (19).

$$R_{BLout}=R_{ave}$$

$$G_{BLout}=G_{ave}$$

$$B_{BLout}=B_{ave} \tag{19}$$

The intensity distribution estimator 110 estimates the intensity 111 of light incident on each pixel position of the liquid crystal panel 120 when each light source irradiates light on the liquid crystal panel 120 in accordance with the light source intensity value 109 thereof. The light source intensity distribution 111 calculated by the intensity distribution estimator 110 is inputted into the signal corrector 112. The signal corrector 112 corrects the input video signal 103 in accordance with the intensity distribution 111 to obtain the corrected video signal 113 to be transmitted to the liquid crystal controller 115. The liquid crystal controller 115 generates the liquid crystal control signal 117 based on the corrected video signal 113 and transmits the liquid crystal control signal 117 to the liquid crystal panel 120, and the liquid crystal panel 120 displays a video picture in the display region by modulating light from the backlight 119 depending on the liquid crystal control signal 117. Further, the light source controller 114 generates the light source intensity control signal 116 based on the light source intensity value 109 transmitted from the intensity value corrector 108 and transmits the light source intensity control signal 116 to the backlight 119, and the backlight 119 makes each light source or each colored light source emit light in accordance with the light source intensity control signal 116.

In the present embodiment, as in the first embodiment or the second embodiment, uneven brightness can be prevented while restraining power consumption, and in addition, unnatural variation in the brightness of emitted light of the light source can be reduced. The reduction effect of unnatural brightness variation will be explained by using FIG. 11 and FIG. 12.

Figure 11:
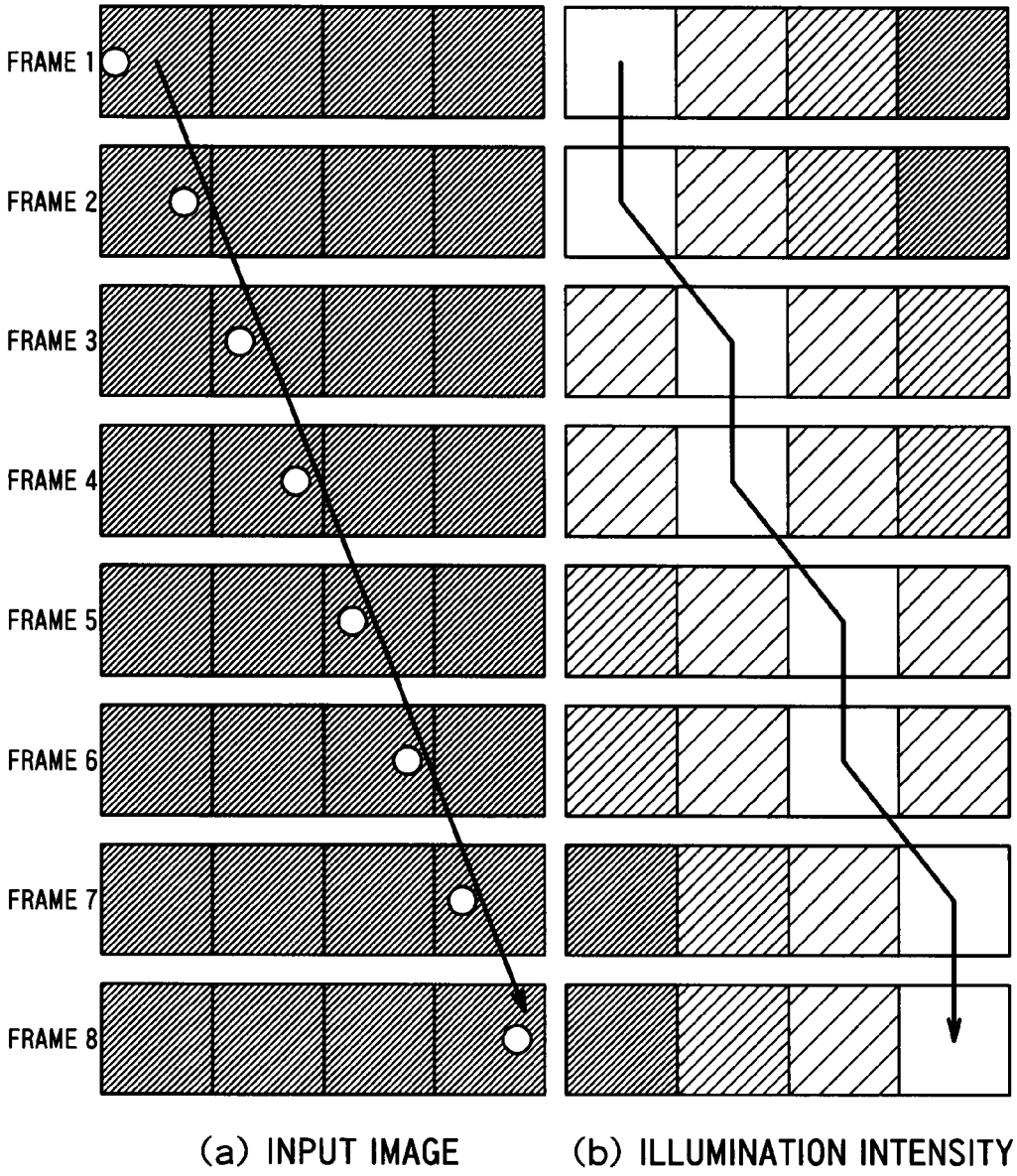
FIG. 11 is a diagram explaining an effect of the third embodiment.
Figure 12:
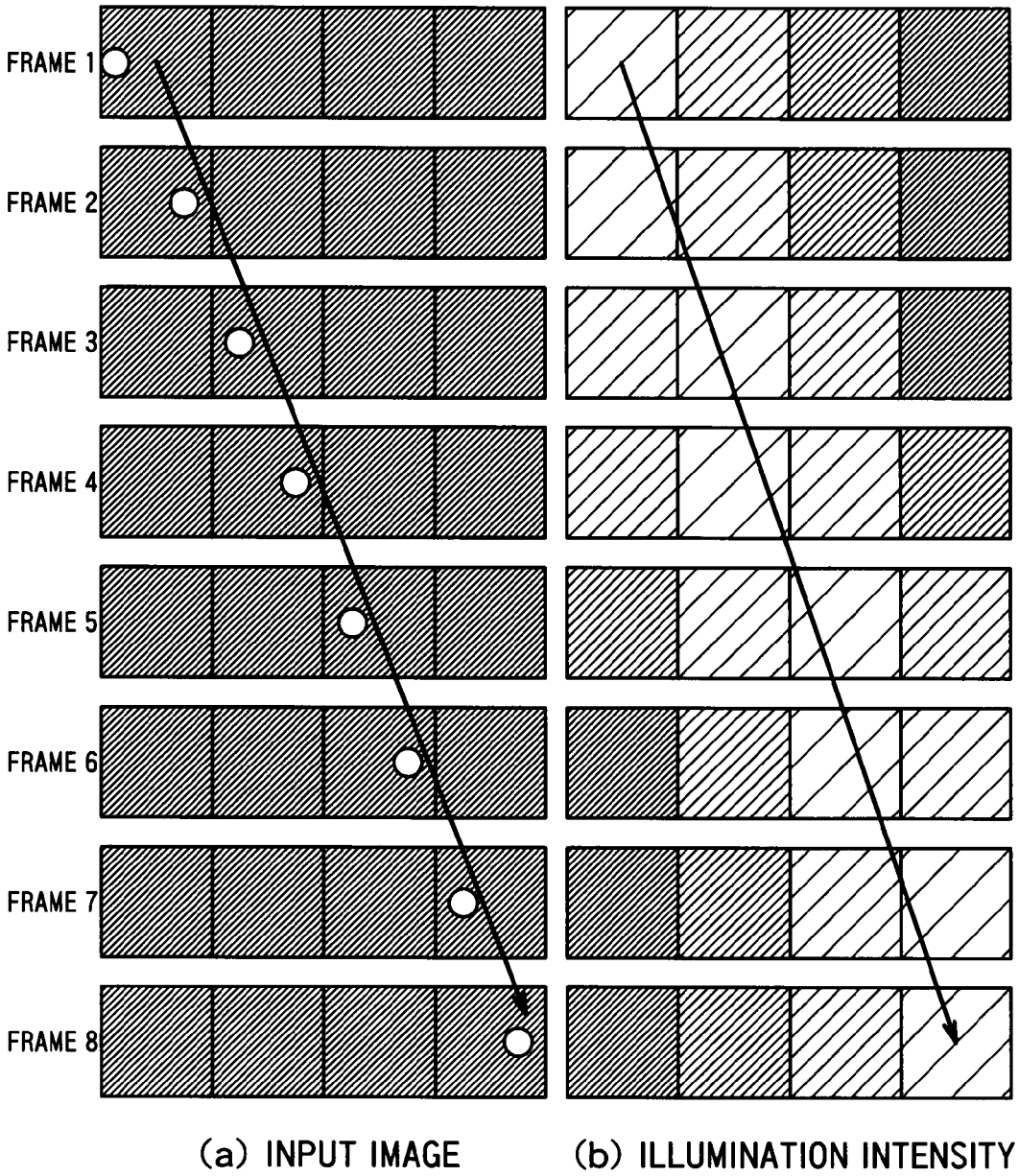
FIG. 12 is a diagram explaining an effect of the third embodiment.

Each of FIG. 11(*a*) and FIG. 12(*a*) shows 1×4 illumination regions (1 in the vertical direction and 4 in the horizontal direction) through which a bright spot in the input image moves (FIG. 11(*a*) and FIG. 12(*a*) are the same drawings). The bright spot moves from the most left illumination region to the right as the frame number becomes larger.

FIG. 11(*b*) shows the transition in the light source intensity of the illumination region based on the conventional method, while FIG. 12(*b*) shows the transition in the light source intensity based on the proposed method.

As shown in FIG. 11(*b*), when the light source intensity is set based on the conventional method, frame 1 and frame 2 have the same intensity in each illumination region regardless of the actual movement of the bright spot, and thus light emission pattern becomes discontinuous compared to the movement of the bright spot and unnatural brightness variation is observed. On the other hand, as shown in FIG. 12(*b*), when the light source intensity is set based on the proposed method, the intensity of each illumination region changes as the bright spot passes through the boundary of the subregion, and thus unnatural brightness variation can be reduced.

As stated above, according to the present embodiment, in an input image having bright and dark areas, the intensity of each illumination region can be smoothed without considerably reducing the intensity values of the illumination regions having large intensity values and without excessively increasing the intensity values of the illumination regions having small intensity values, and an image and a video picture without uneven brightness and unnatural brightness variation can be displayed with low power consumption.

The invention claimed is:

1. A liquid crystal display comprising:

a backlight having a plurality of light sources each configured to emit light, light intensity of each light source being controllable;

a liquid crystal panel configured to display a video picture in a plurality of illumination regions corresponding to the light sources by modulating the light from the backlight;

an intensity value calculator configured to calculate representative intensity values of the illumination regions based on an input video signal including signal values of a plurality of pixels;

a weight calculator configured to perform a smoothing process on the representative intensity values in spatial domain by using first weights which are defined for the illumination regions, and to calculate second weights of the illumination regions such that the second weights have larger values as differences between smoothed values of the representative intensity values and the representative intensity values are larger when the smoothed values of representative intensity values are smaller than the representative intensity values, and have a predetermined value when the smoothed values of representative intensity values are larger than or equal to the representative intensity values, respectively;

an intensity value corrector configured to correct the representative intensity values of the illumination regions based on the second weights and perform a smoothing process on corrected representative intensity values in spatial domain to obtain light source intensity values of the light sources;

an intensity distribution estimator configured to estimate light intensity distribution in the illumination regions when the light sources emit the light with the light source intensity values;

a signal corrector configured to correct the input video signal based on the intensity distribution to obtain a corrected video signal;

a light source controller configured to control the light sources so that the light sources emit light with intensity having the light source intensity values; and a liquid crystal controller configured to control modulation of the liquid crystal panel in accordance with the corrected video signal.

2. The device of claim 1, wherein the light source has a plurality of colored light sources each of which emits light of a different color, light intensity of each colored light source being separately controllable, the input video signal includes signal values of a plurality of colors with respect to each of the pixels, the intensity value calculator calculates the representative intensity values with respect to each of the colors, the weight calculator calculates the second weights with respect to each of the colors, and the intensity corrector calculates the light source intensity values with respect to each of the colors.

3. The device of claim 1, wherein the intensity value calculator calculates a maximum value among signal values of pixels in each of the illumination regions as the representative intensity values of each of the illumination regions.

4. The device of claim 1, wherein the intensity value calculator calculates the representative intensity values of the illumination regions by multiplying a central lightness value between a maximum lightness value and a minimum lightness value of pixels in each of the illumination regions by a predetermined constant.

5. The device of claim 1, wherein the weight calculator calculates the second weights by dividing the representative intensity values by the smoothed values of the representative intensity values when the smoothed values of representative intensity values are smaller than the representative intensity values, and sets the second weights to 1 as the predetermined value when the smoothed values of representative intensity values are larger than or equal to the representative intensity values, respectively.

6. A device comprising:

a backlight having a plurality of light sources each configured to emit light, light intensity of each light source being controllable;

a liquid crystal panel configured to display a video picture in a plurality of illumination regions corresponding to the light sources by modulating the light from the backlight, each of the illumination regions being formed of a plurality of subregions;

a subregion intensity value calculator configured to calculate representative intensity values of the subregions based on an input video signal including signal values of a plurality of pixels;

a weight calculator configured to perform a smoothing process on the representative intensity values of the subregions in spatial domain by using first weights which are previously defined for the subregions, and to calculate second weights of the subregions such that the second weights have larger values as differences between smoothed values of the representative intensity values and the representative intensity values are larger when the smoothed values of representative intensity values are smaller than the representative intensity values, and have a predetermined value when the smoothed values of representative intensity values are larger than or equal to the representative intensity values, respectively;

an intensity value corrector configured to correct the representative intensity values of the subregions based on the second weights and perform a smoothing process on corrected representative intensity values by using the first weights to obtain smoothed intensity values of the subregions;

an intensity value determiner configured to determine light source intensity values of the light sources based on the smoothed intensity values of the subregions;

an intensity distribution estimator configured to estimate light intensity distribution in the illumination regions when the light sources emits the light with the light source intensity values;

a signal corrector configured to correct the input video signal based on the intensity distribution to obtain a corrected video signal;

a light source controller configured to control the light source so that the light sources emits light with intensity of the light source intensity values; and a liquid crystal controller configured to control modulation of the liquid crystal panel in accordance with the corrected video signal.

7. The device of claim 6, wherein the light source has a plurality of colored light sources each of which emits light of a different color, light intensity of each colored light source being separately controllable, the input video signal includes signal values of a plurality of colors with respect to each of the pixels, the subregion intensity value calculator calculates the representative intensity values with respect to each of the colors, the weight calculator calculates the second weights with respect to each of the colors, and the intensity corrector performs correction of the representative intensity values and the smoothing process with respect to each of the colors, and the intensity value determiner determines the light source intensity values with respect to each of the colors.

8. The device of claim 7, wherein the intensity value determiner obtains the light source intensity values of the light sources by averaging signal values of the subregions in each of the illumination regions, with respect to each of the colors.

9. The device of claim 7, wherein the intensity value determiner obtains the light source intensity values of the light sources by multiplying a maximum value among signal values of the subregions in each of the illumination regions by a coefficient determined for each of the illumination regions, with respect to each of the colors.

10. The device of claim 6, wherein the subregion intensity value calculator calculates a maximum value among signal values of pixels in each of the subregions as the representative intensity values of each of the subregions.

11. The device of claim 6, wherein the subregion intensity value calculator calculates the representative intensity values of the subregions by multiplying a central lightness value between a maximum lightness value and a minimum lightness value of pixels in each of the subregions by a predetermined constant.

12. The device of claim 6, wherein the weight calculator calculates the second weights by dividing the representative intensity values by the smoothed values of the representative intensity values when the smoothed values of representative intensity values are smaller than the representative intensity values, and sets the second weights to 1 as the predetermined value when the smoothed values of representative intensity values are larger than or equal to the representative intensity values, respectively.

* * * * *